US005909498A

United States Patent [19]

Smith

[11] Patent Number: 5,909,498

[45] Date of Patent: Jun. 1, 1999

[54] TRANSDUCER DEVICE FOR USE WITH COMMUNICATION APPARATUS

[76] Inventor: Jerry R. Smith, 5690 W. Rowland Ave., Littleton, Colo. 80123

[21] Appl. No.: 08/037,567

[22] Filed: Mar. 25, 1993

[51] Int. Cl.[6] ..... H04K 25/00

[52] U.S. Cl. ..... 381/380; 381/375

[58] Field of Search ..... 381/686, 96, 183, 381/187, 158, 68, 68.2, 68.4, 68.7, 71, 72, 68.6, 74, 322, 328, 71.6, 71.7, 327, 370, 371, 375, 376, 380; 379/430

[56] References Cited

U.S. PATENT DOCUMENTS

| | | | |
|---|---|---|---|
| 2,971,065 | 2/1961 | Busse | 381/68.4 |
| 2,987,584 | 6/1961 | Webber et al. | 381/68.6 |
| 3,301,955 | 1/1967 | Clements, Jr. | 381/68 |
| 3,890,474 | 6/1975 | Glicksberg | 381/72 |
| 3,894,169 | 7/1975 | Miller | 428/425 |
| 3,952,158 | 4/1976 | Kyle et al. | 381/72 |
| 4,064,362 | 12/1977 | Williams | 381/72 |
| 4,516,428 | 5/1985 | Konomi | 381/151 |
| 4,588,867 | 5/1986 | Konomi | 381/151 |
| 4,833,719 | 5/1989 | Carme et al. | 381/72 |
| 5,001,763 | 3/1991 | Moseley | 381/71 |
| 5,182,774 | 1/1993 | Bourk | 379/430 |

*Primary Examiner*—Huyen Le

*Attorney, Agent, or Firm*—Timothy J. Martin; Michael R. Henson

[57] ABSTRACT

A transducer device includes a pair of transducers in the form of a speaker element and a microphone element mounted in a common housing that may be positioned and retained in the external auditory canal of the human ear thereby allowing the user to interface with communications apparatus. The housing is structured to acoustically isolate the microphone and the speaker sufficiently to avoid feedback, i.e., audio coupling. In one embodiment, this isolation is accomplished by a layer of acoustical damping material interposed between the two transducers. In another embodiment, isolation is accomplished by using a separate guide structure for each transducer. In a third embodiment, isolation is accomplished by a ported metallic plate interposed between the two transducers.

2 Claims, 4 Drawing Sheets

TRANSDUCER DEVICE FOR USE WITH COMMUNICATION APPARATUS

FIELD OF THE INVENTION

The present invention generally relates to audio input/output transducers that may be used with communications apparatus in order to convert transmitted signals to audible output and to convert audible input into signals that may be transmitted by the communications system. Thus, the present invention relates to a combination speaker/microphone that may be used, for example, with telephone systems, radio transmitter/receivers, and the like.

BACKGROUND OF THE INVENTION

Since the invention of communication systems in the 19th century, the use of communication equipment has expanded to touch nearly all aspects of modern day life. Most industrialized countries enjoy a wide variety of transmitted communications, including, for example, telephones, television, radio, etc. While some such systems are simply passive receivers, many communication devices are interactive, that is, they permit both the receipt and transmission of signals that are converted from a carrier signal to a receivable output. In all such systems, it is necessary to have one type of transducers that will convert perceivable data, such as visual images and audible sounds, into the carrier format, and a second type of transducers that will reconvert the carrier format into the perceivable visual or audio information.

In most two-way communication systems, a user is provided with a microphone which converts audible sounds into the carrier format and a speaker which converts the carrier format to reproduce the audible sound. In early communication systems, the microphone and speaker(s) were structured as separately housed components so that the microphone could be positioned immediately forward of the mouth while the speaker(s) were positioned proximate to the ears. For example, early telephones had a speaker connected to a cord so that the user could hold the speaker proximate to his/her ear while speaking directly into the microphone portion of the telephone. Radios commonly used earphones for speakers which were clamped over the head and ears while the user spoke into a separate microphone.

The physical structure of telephones, of course, developed further into the well-known hand-held receivers that are "dumb-bell" in shape and, of course, their more modern progeny. In these receivers, the speaker and microphone are housed in a common shell but are physically separated from each other a distance approximating the distance between the mouth and ear of an adult user. This physical spacing allowed the microphone to be placed forward of the mouth while the speaker, i.e., the earphone, was placed proximate to the ear. This physical separation reduced the likelihood of feedback wherein the audible signals produced by the speaker would be received by the microphone and retransmitted. Notwithstanding the improvements of such hand-held receivers, a problem still remained in that the user was required to hold the receiver in one hand against his/her head during use. Accordingly, the user only had one free hand which could be employed at other activities while utilizing the hand-held receiver. For this reason both "hands free" receivers and "speaker phones" were developed.

"Hands free" receivers have taken many forms. Prominent among these are those types of physical supports, such as brackets or cushions which were mounted to the receiver and which would allow the user to hold the receiver between his/her head and shoulder. A more recent "hands free" receiver employs a headset which positions a speaker earpiece in the ear and which includes a forward arcutately extending arm that supports a light-weight microphone forwardly of the mouth. The headset is held onto the head by means of a resilient bracket extending across the top of the head. While such headsets represent substantial improvement over prior receivers and are therefore quite popular, they nonetheless have the disadvantage of depending the microphone in front of the user's face which can be uncomfortable and distracting.

Speaker phones, of course, do not have the problem of speaker/microphone headsets. However, speaker phones suffer from transmitted sound quality due to the positioning of the microphone away from the user, usually by several feet. Furthermore, to prevent feedback, electronic cut-off circuitry may be employed so that activation of the microphone deactivates the speaker portion of the speaker phone. This naturally intrudes on the smoothness of any conversation and is an undesirable drawback of such systems.

SUMMARY OF THE INVENTION

It is an object of the present invention to provide a new and useful transducer device which may be employed with traditional communication equipment, such as radios and telephones, in order to permit two-way communication between a user and another party.

Another object of the present invention is to provide a transducer in which both microphone and speaker elements are housed commonly in a compact unit which is structured to prevent feedback between the speaker and microphone portions and which may be supported by the ear of the user.

A further object of the present invention is to provide a transducer device having both microphone and speaker elements arranged in a common, compact unit structured to minimize audio coupling between the elements and configured to be received in the external auditory canal of the human ear.

Another object of the present invention is to provide a transducer device having both a speaker and microphone wherein the microphone portion is positioned away from the face of the user and proximate to the ear and which microphone can respond to the voice of the user without receiving feedback from the speaker.

A further object of the present invention is to provide an inexpensive transducer, using readily available speaker and microphone components which are housed in a compact module that may be supported by the ear of a user yet which includes physical structure that sufficiently acoustically isolates the speaker and microphone to prevent feedback during two-way communication.

To accomplish these objects, then, the present invention provides a transducer device that is operative with conventional communications apparatus and that is adapted to be placed proximately to the external auditory canal of the user's ear in order for the user to interface with the communications apparatus. The transducer device is operative to produce audible output in response to input signals received from the communications apparatus and is operative to produce output signals in response to audible input from the user such that output signals originating with the user may be transmitted by the communications apparatus.

Generally, the invention includes a speaker element and a microphone element which are disposed within a housing that is configured to be positioned in a mounted state at a location proximately to the external auditory canal of the user's ear. Thus, both the speaker element and the microphone element are located proximately to the ear when in a mounted state. The speaker element is operative to receive input signals from the communications apparatus and produce an audible output in response thereto. The microphone element is operative to receive audible input from the user and produce output signals in response thereto so that the output signals may be transmitted by the communications apparatus. The microphone element and the speaker element are acoustically isolated from one another sufficiently such that the audible output from the speaker element does not create feedback to the microphone element. Preferably, the speaker element is directional so that it has a primary audio output vector for the audio output thereof, and the microphone element is directional so that it has a primary audio input vector corresponding to its direction of greatest sensitivity.

Several different exemplary embodiments of this general structure are disclosed. In one exemplary embodiment, the microphone and speaker elements are disposed within an internal chamber formed in the housing structure. The isolation structure includes a layer of acoustical damping material interposed between the speaker element and the microphone element. Here, it is preferred that the primary audio output vector of the speaker is directed away from the layer of acoustical damping material and toward the external auditory canal of the ear when the device is in the mounted state. The primary audio input vector is preferably located in a direction opposite the primary audio output vector, and it is preferred that these vectors be colinear. Furthermore, the microphone element may contact the layer of acoustical damping material and, indeed, be potted therein. The acoustical damping material is selected from a group preferably consisting of: silicone, epoxy and polyvinyl siloxane. In another exemplary embodiment, instead of using damping material, the isolation structure includes a ported metallic plate interposed between the speaker element and the microphone element.

Further exemplary embodiments utilize acoustic guides to act as isolation structure between the microphone element and the speaker element. It is preferred that two such acoustic guides are provided, a first acoustic guide being associated with the microphone element and a second acoustic guide being associated with the speaker element. Preferably, the first and second acoustic guides are passageways having different dimensional cross-sections. Furthermore, the first and second acoustic guides are preferred to be tubular in shape. In one embodiment, portions of the first and second acoustic guides are coaxial with one another. In another embodiment, the first and second acoustic guides have portions oriented alongside one another. Finally, in yet another embodiment, the first and second acoustic guides have passageway portions oriented orthogonally with respect to one another. The first and second tubular guides respectfully have first and second guide outer portions which respectively terminate in a first guide opening opposite the microphone element and a second guide opening opposite the speaker element. Where the first and second guide outer portions are oriented parallel to one another, it is preferred that the guide openings be located in different transverse planes.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention is directed to transducer devices adapted as output/input devices for communications systems, such as telephones, radios, and the like. In all cases, the transducer device includes both a speaker element and a microphone element which are housed in a manner so that they together may be placed in a mounted state proximately to a user's ear thereby permitting "hands free" operation. Furthermore, in each case, the speaker element and the microphone element of the transducer device are acoustically isolated from one another by physical structure in a manner sufficient to prevent feedback from the speaker element to the microphone element. Thus, the speaker element may emit audio signals directed into the user's ear while the microphone element is sensitive enough to pick up the speaker's voice through the bone structure and resonant cavities of the head without the need for the speaker element to be mounted on a bracket or gangarm extending around the head to a location in front of the speaker's mouth. The differing exemplary embodiments directed to the different isolation structure which have been found to be affective in preventing feedback.

Figure 1:
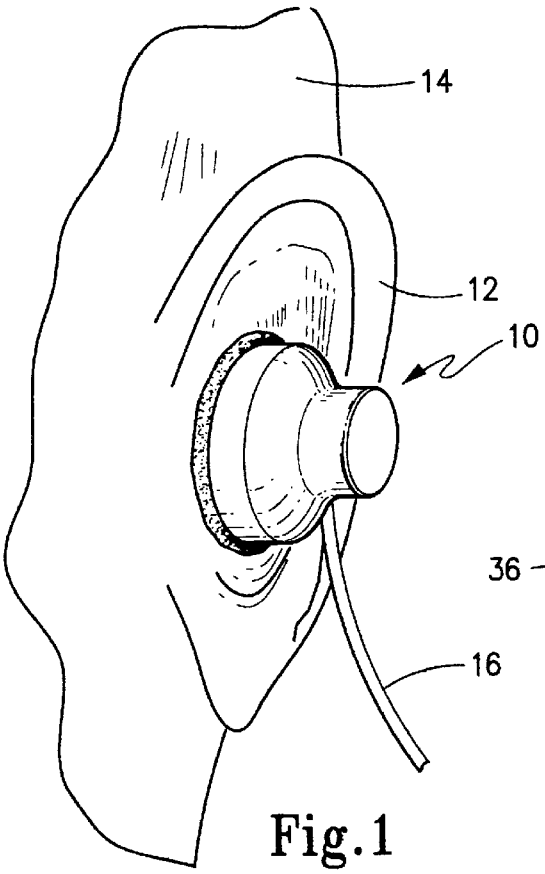
FIG. 1 is a perspective view of the first exemplary embodiment of a transducer device according to the present invention shown in a mounted state in the ear of a user.
Figure 2:
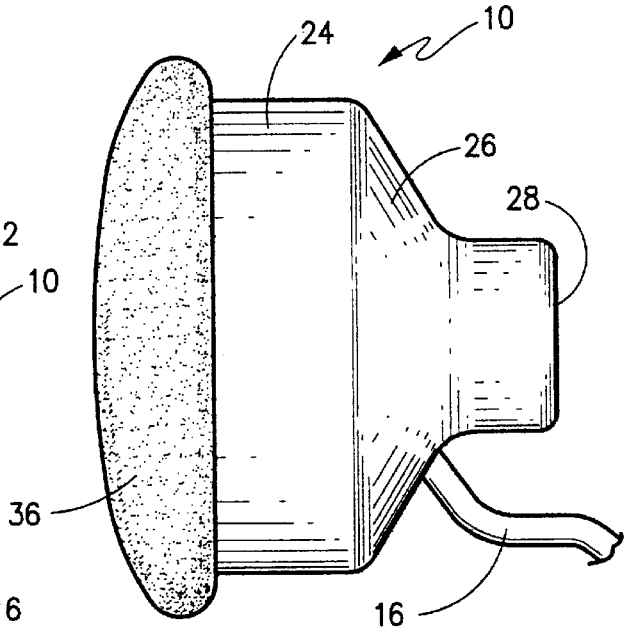
FIG. 2 is a side view in elevation of the transducer device shown in FIG. 1.
Figure 3:
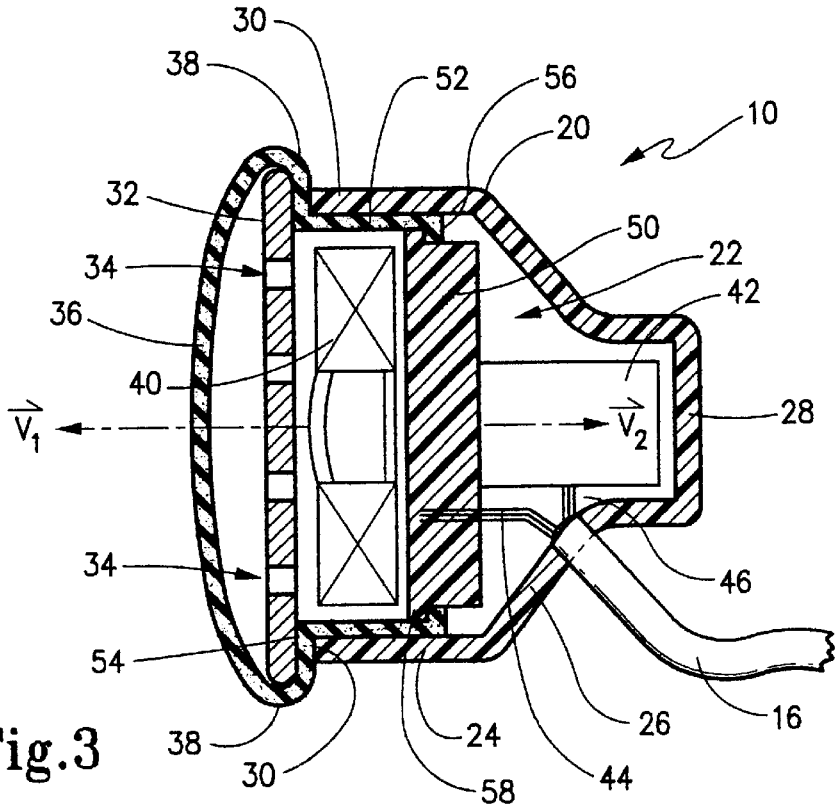
FIG. 3 is a cross-sectional view of the transducer device shown in FIGS. 1 and 2.

With reference, then, to FIGS. 1–3, a first exemplary embodiment of the present invention is shown wherein a transducer device 10 is secured in a mounted state in ear 12 of user 14. It may be seen in FIG. 1, that transducer device 10 is mounted proximately to the external auditory canal, that is the external opening centrally located within ear 12. An electrical cable 16 is provided to place transducer device 10 in communication with a communications apparatus (not shown) of a conventional type generally known in the art. Thus, transducer device 10 may serve in place of the handset/receiver of a standard telephone or radio microphone and earphone combinations. Furthermore, it should be understood that it is within the scope of the present invention that communication between transducer device 10 and the communications systems could be accomplished by any technique now known or subsequently developed. For example, it would be possible that a wireless interconnect be established between transducer device 10 and a base unit of a communications systems, so that the user is not tethered to the based unit by means of electrical lead 16. Furthermore, it is conceivable that transducer device 10 could also be connected to an ear-mounted communications system, such as a cellular telephone unit, with the constraints of such structure being limited by weight and miniaturization considerations.

As is shown in FIGS. 2 and 3, transducer device 10 includes a housing 20 in the form of a shell having an interior chamber 22. Housing 20 has a cylindrical portion 24 and a frustoconical portion 26 which terminates in a closed end 28. Housing 20 is preferably formed of molded plastic and has an open end defined by rim 30 opposite closed end 28. The open end of housing 20 is then enclosed by metal plate 32 through which a plurality of ports 34 are formed. A cushion 36 encapsulates metal plate 32 for comfortable mounting in ear 12. Cushion 36 may preferably be formed of any soft, resilient material, such as foam material, and has an inwardly turned lip 38 at its perimeter which resiliently grips the outer peripheral edge of plate 32.

A speaker element 40 of conventional construction is disposed in chamber 22 of housing 20 proximately to plate 32. Speaker 40 is preferably directional in type and thus has a primary audio output vector $\vec{V}_1$. For purposes of this description, the primary audio output vector is the primary direction in which the magnitude of the audio output energy is focused by speaker 40 where, for example, speaker 40 is a unidirectional speaker; alternatively, it could be viewed as the central axis of the audio output of speaker 40.

A microphone element 42 is likewise disposed in chamber 22 of housing 20 but is located at a portion there opposite speaker element 40, that is, proximately to closed end 28. Microphone element 42 is of standard construction and has a primary audio input vector.$\vec{V}_2$ which is the most sensitive response direction for microphone 42, for example, where microphone 42 is a unidirectional microphone. A first pair of leads 44 and a second pair of leads 46 are provided by electrical cable 16 and are respectfully connected to speaker element 40 and microphone element 42 in order to transmit electrical output and input signals.

In order the acoustically isolate microphone element 42 from speaker element 40 so that audio output from speaker element 40 does not create feedback into microphone element 42, a disk-shaped layer 50 of acoustic damping material is interposed between speaker element 40 and microphone element 42, and is retained in position by means of annular cylindrical support 52. As is shown here, support 52 has a diameter slightly smaller than the diameter of cylindrical portion 24 of housing 20 so that it may be telescopically received in close-fitted engagement therein. To facilitate attachment, annular support 52 has an outwardly turned shoulder 54 against which rim 30 abuts and may be fastened by means of adhesive, ultrasonic welding, or the like, as is known in the art. Annular support 52 includes an inwardly turned rim 56 which mates with a lip 58 of layer 50 in order to retain layer 50 in the interposed position between speaker element 40 and microphone element 42. As is shown also in this FIG. 3, microphone element 42 may be in contact with layer 50 and indeed, may be potted directly onto layer 50 centrally thereof so that primary input vector $\vec{V}_2$ is colinear with but oppositely directed with respect to primary audio output vector$\vec{V}_2$. To this end, layer 50 is preferably formed of a silicone, epoxy or polyvinyl siloxane composition, or such other suitable composition found to be sufficient to acoustically isolate speaker element 40 and microphone element 42 sufficiently to prevent feedback, as described above.

In use, a user simply mounts transducer device 10 directly in his/her ear so that cushion portion 36 is received in the opening of the external auditory canal thereby frictionally retaining transducer device 10 within the ear. Alternatively, a bracket assembly may be fastened to transducer device 10 with such bracket assembly extending over the head, as is standard with earphones, or around ear 12 to add further support against dislodgment of transducer device 10 from the ear. Upon the receipt of input signals from the communications apparatus, speaker element 40 responds to produce audio output which is directed along the primary audio output vector into the external auditory canal of the ear so that the user may listen to the audible output. When the user speaks, using a normal voice, microphone element 42 picks up such audible input directly from the bone structure or resonant cavities of the head and converts the audible input into an output signal for transducer device 10 that may then be transmitted by the communications apparatus, thus establishing two-way communication.

Figure 4:
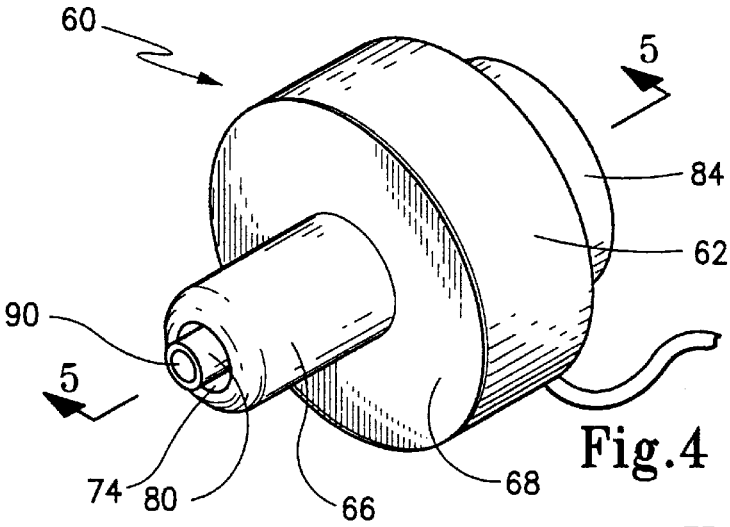
FIG. 4 is a perspective view of a second exemplary embodiment of a transducer device according to the present invention.
Figure 5:
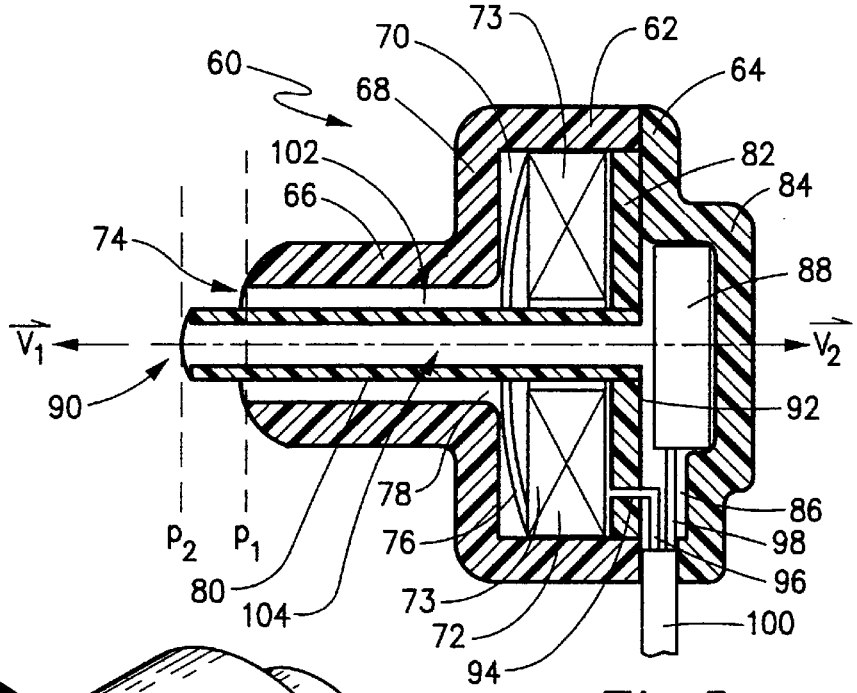
FIG. 5 is a cross-sectional view taken about lines 5—5 of FIG. 4.

As noted above, other possible isolation structures may be used without departing from the general inventive concept of this invention. One such exemplary alternative embodiment is shown in FIGS. 4 and 5. Here, transducer device 60 is formed with a cylindrical shell portion 62 having an open end defined by a rim 64 and a tubular guide piece 66 projecting axially from an annular endwall 68 opposite rim 64. Cylindrical shell portion 62 thus forms an open interior or chamber 70 in which is disposed a speaker element 72 which in is shown to have a primary audio output vector $\vec{V}_1$. Speaker element 72 is positioned so that vector $\vec{V}_1$ is located along the central axis thereof and, correspondingly, along the central axis of tubular guide piece 66. Tubular guide piece 66 terminates in a guide opening 68 that is oriented in a plane P1 that is transverse to the central axis of 66 and thus transverse to primary audio output vector $\vec{V}_1$.

Speaker element 72 is again of construction within the known skill in the art and is here shown to include an arcuate metal diaphragm 76 that has an axial bore 78 extending centrally therethrough and through speaker coil 73. A second tubular guide piece 80 extends axially through bore 78 and is supported coaxially with tubular guide piece 66 by means of a disk-shaped support 82 received in the open end of cylindrical shell portion 62 in close-fitted engagement. An end cap 84 mounts onto rim 64, by means of adhesive, ultrasonic welding, etc., and holds support 82 in position. End cap 84 defines a second chamber portion 86 in which is mounted a microphone element 88. It should be understood that, when end cap 84 is secured onto cylindrical housing portion 62, chamber portions 70 and 86 may be considered as one common internal chamber with support 82 being disposed therein in interposed relation between speaker element 72 and microphone element 88.

Microphone element 88 has a primary audio input vector $\vec{V}_2$ and is secured centrally by end cap 84 so that input audio input vector $\vec{V}_2$ is colinear with but oppositely directed with respect to primary audio output vector $\vec{V}_1$ of speaker element 72. To this end, also, it should be appreciated that microphone element 88 is secured to second guide piece 80 at one end opposite second guide opening 90 which is oriented in transverse plane P2 parallel to but spaced-apart forwardly of transverse plane P1. Support 82 accordingly has a central opening 92 sized to permit guide piece 80 to extend therethrough. A second, smaller bore 94 is provided to permit interconnection of electrical leads 96 to speaker element 72, while electrical leads 98 are connected directly to microphone element 88. Leads a96 and 98 are carried by electrical cable 100, similarly to electrical cable 16, described above.

In this embodiment, acoustical isolation of speaker element 72 and microphone element 88 is accomplished by means of guide pieces 66 and 80. Audio output from speaker element 72 is channeled outwardly between annular passageway 102 located between guide piece 66 and guide piece 80 while audio input for microphone element 88 is channeled in the direction of $\vec{V}_2$ along interior passageway 104 of guide piece 80. It has been found helpful in accomplishing the best acoustical isolation that the diameter of the two guide pieces be constructed so that passageways 102 and 104 to have different cross-sectional areas, as is shown in FIG. 5, and that the openings of the respective guide pieces be oriented in different transverse planes. Furthermore, it is preferred that an end portion of the microphone acoustical guide piece 80 protrude outwardly from opening 74 of acoustical guide 66 for speaker element 72.

Figure 6:
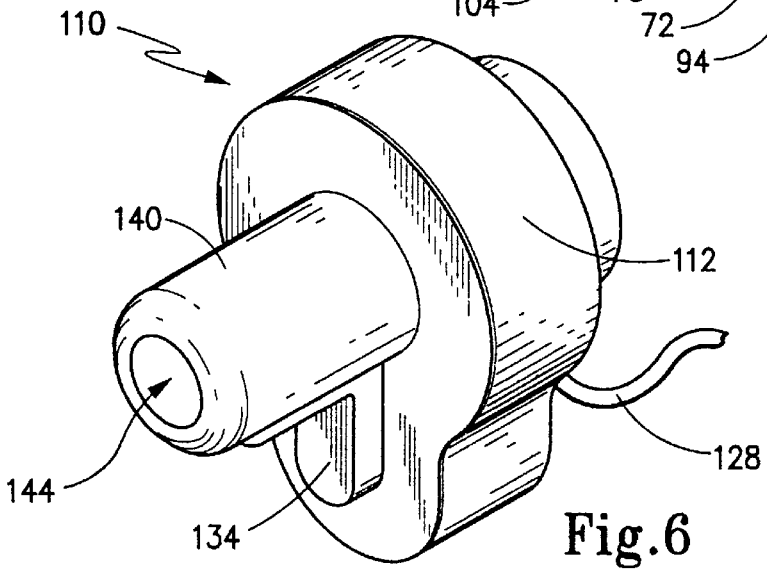
FIG. 6 is a perspective view of a third alternative exemplary embodiment of a transducer device according to the present invention.
Figure 7:
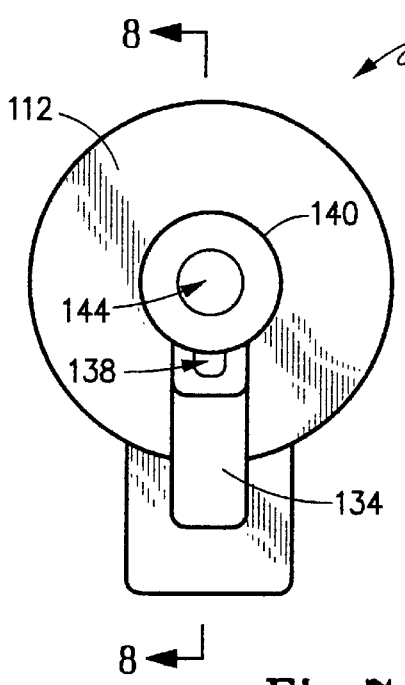
FIG. 7 is an end view in elevation of the transducer device shown in FIG. 6.
Figure 8:
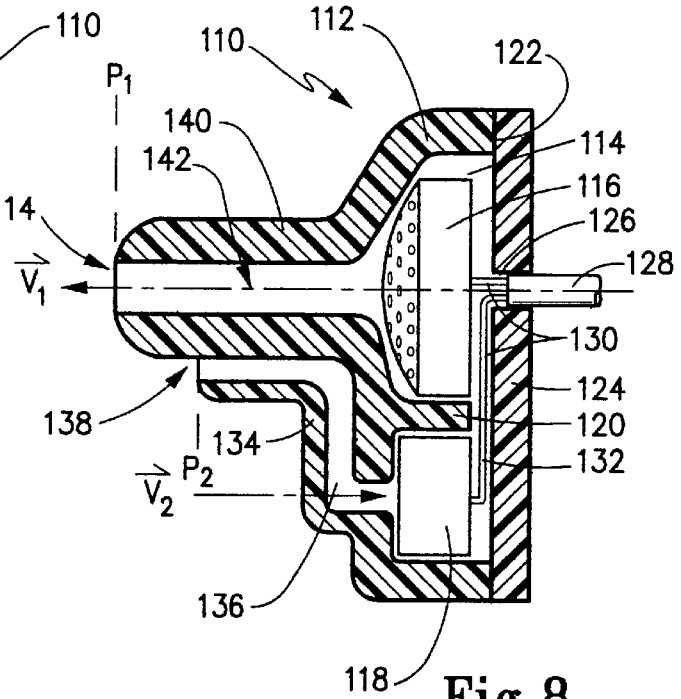
FIG. 8 is a cross-sectional view taken about lines 8—8 of FIG. 7.

A third exemplary embodiment of the present invention is shown in FIGS. 6–8. It may be noted in this embodiment that the acoustical guides are not coaxial so that the speaker element and the microphone element may be positioned in side-by-side relation instead of end-to-end. With reference to these Figures, then, it may be seen that transducer device 110 includes a housing 112 having an interior 114 in which a speaker element 116 and a microphone element 118 are positioned in side-by-side relation and are held in position by means of a web 120. Housing 112 has a rim 122 defining an opening to allow speaker element 116 and microphone element 118 to be mounted in interior 114, and an endwall 124 encloses this opening and is secured to rim 122 in any convenient manner. Endwall 124 includes a bore 126 through which cable 128 may extend so that electrical leads 130 and 132 may be respectively connected to speaker element 116 and microphone element 118.

In order to acoustically isolate speaker element 116 and microphone element 118, housing 112 has a pair of acoustic guide pieces formed integrally therewith. A first guide piece is associated with microphone element 118 and is formed by serpentine tubular portion 134 having a guide passageway 136 extending from chamber 114 at a location proximate to microphone 118 to terminate in an opening 138 oppositely of microphone element 118. A second acoustic guide piece is in the form of tubular guide piece 140 formed integrally with housing 112 and includes a central passageway 142 that terminates at guide opening 144.

Here again, it may be seen that guide passageways 136 and 142 have different geometric cross-sections and that guide openings 144 and 138 respectively terminate in plane P1 and P2 which are parallel to but located in spaced-apart relation to one another. Instead of being coaxial with one another, the acoustic guides formed by guide pieces 140 and 134 have portions oriented alongside one another. Thus, for example, guide 134 includes guide portion 146 oriented alongside and parallel to the central axis of guide 140. Furthermore, as may be seen with reference to FIG. 8, the primary output vector $\vec{V}_1$ of speaker element 116 is parallel to but spaced from primary input vector $\vec{V}_2$ for microphone element 118 with these vectors being oppositely directed.

Figure 9:
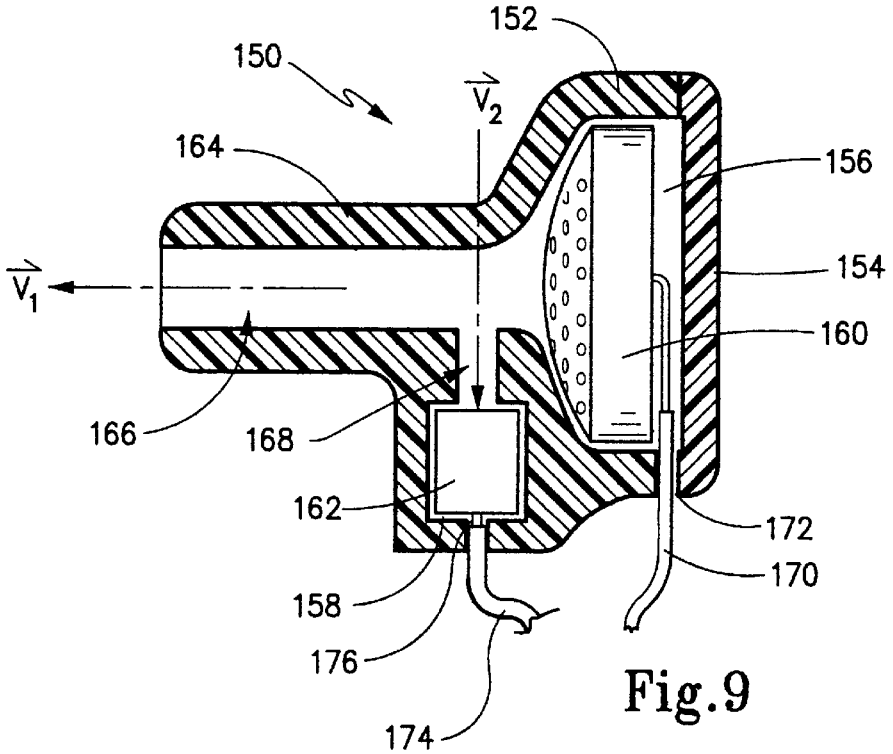
FIG. 9 is a cross-sectional view of a fourth exemplary embodiment of a transducer device according to the present invention.

Yet another exemplary embodiment of the invention is shown in FIG. 9. Here, transducer device 150 is formed by housing 152 closed at one end by an endwall 154. Housing 152 forms a pair of chambers 156 and 158 which respectively receive speaker element 160 and microphone element 162. An elongated tubular guide 164 extends outwardly from housing 112 opposite endwall 154 so that it is coaxial with primary audio output vector $\vec{V}_1$ of speaker element 160. Tubular guide 164 thus defines a guide passageway 166 through which audible output may be broadcast by speaker element 160. A transverse guide path 168 extends radially of guide path 166 to provide an acoustical guide for microphone element 162. Thus, guide passageway 168 extends coaxially with the primary audio input vector $\vec{V}_2$ for microphone element 162. Thus, it may be seen that the guide passageways 166 and 168 are oriented orthogonally with respect to one another as are vectors $\vec{V}_1$ and $\vec{V}_2$. Electrical connection to speaker element 160 is provided by means of electrical lead 170 extending through bore 172 in housing 152, while electrical connection to microphone element 162 is provided by electrical cable 174 extending through bore 176 in housing 152.

Figure 10:
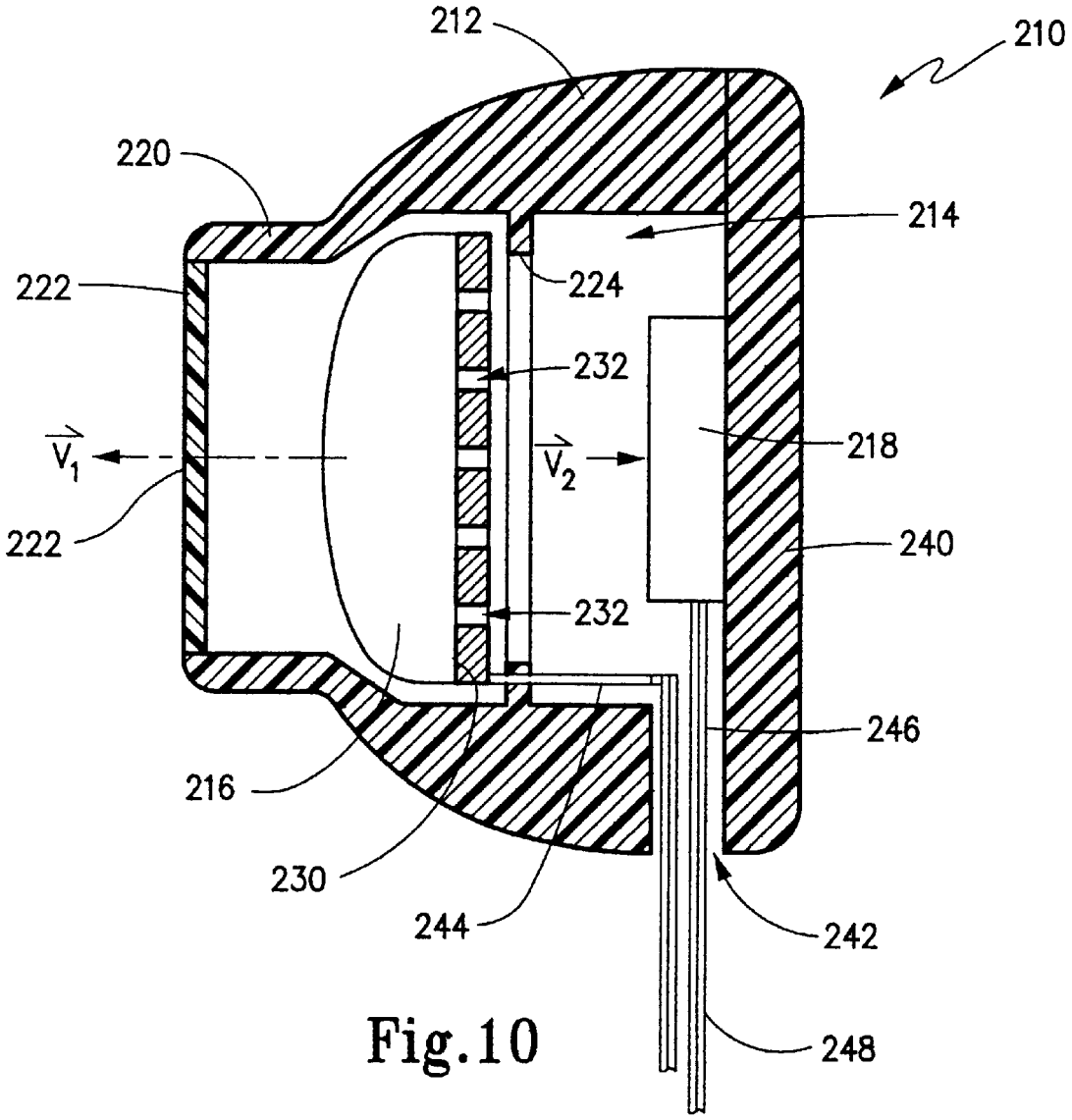
FIG. 10 is a cross-sectional view of a fifth alternative embodiment of a transducer device according to the present invention.

A final alternative embodiment of the present invention is shown in FIG. 10. Here, transducer device 210 is formed by a bell-shaped housing 212 which has an open interior 214 in which is disposed a speaker element 216 and a microphone element 218. An acoustic guide for speaker element 216 is provided by foreshortened tubular portion 220 formed integrally with housing 212, and a flexible diaphragm 222 extends across the outer opening of tubular guide 220. Speaker element 216 is held in position by means of inwardly projecting shoulder 224 so that it is spaced from microphone element 218. Here again, speaker element 216 and microphone element 218 are oriented so that their respective primary audio output and primary audio input vectors $\vec{V}_1$ and $\vec{V}_2$ are colinear but in opposite directions. In order to acoustically isolate speaker element 216 from microphone element 218, speaker element 216 is provided with a disk-shaped metal backing plate 230 provided with a plurality of ports 232 having a cross-section much smaller than the cross-section of tubular guide 220. An endwall 240 mounts onto bell-shaped housing 212 to enclose chamber 214. A bore 242 is provided through which electrical wires 244 and 246 of cable 248 extend to interconnect with speaker element 216 and microphone element 218.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A transducer device adapted to be placed proximately to the external auditory canal of a user's ear in order for the user to interface with communications apparatus and operative to produce audible output in response to input signals received from said communications apparatus and operative to produce output signals in response to audible input for transmission by said communications apparatus, comprising:

(a) a housing sized and configured to be positioned in a mounted state at a location proximately to the external auditory canal of the user's ear;

(b) a speaker element disposed in said housing in communication with said communications apparatus, said speaker element having a primary audio output vector and being oriented so that the primary audio output vector is directed toward the external auditory canal when in the mounted state, said speaker element operative in response to said input signals to produce audible output primarily in a direction along the primary audio output vector;

(c) a microphone element disposed in said housing in communications with said communications apparatus, said microphone element oriented proximately to the ear when in the mounted state and operative to receive audible input and produce output signals in response thereto, said microphone element having a primary audio input vector, said speaker element and said microphone element oriented so that the primary audio output vector and the primary audio input vector are in opposite directions; and (d) an isolation structure of a type configured and positioned to acoustically isolate said microphone element sufficiently from said speaker element such that the audible output from said speaker element does not create feedback to said microphone element.

2. A transducer device operative to permit two-way communication between a user and another party, said transducer device adapted to be placed proximately to the external auditory canal of a user's ear in order for the user to interface with communications apparatus and operative to produce audible output in response to input signals received from said communications apparatus and operative to produce output signals in response to audible input for transmission by said communications apparatus, comprising:

(a) a housing having an internal chamber, said housing sized and configured to be position in a mounted state at a location proximately to the external auditory canal of the user's ear;

(b) a speaker element disposed in said internal chamber in communication with said communications apparatus, said speaker element operative to receive input signals and produce the audible output in response thereto;

(c) a microphone element disposed in said internal chamber in communication with said communications apparatus, said microphone element oriented proximately to the ear when in the mounter state and operative to receive audible input from a user and produce output signals in response thereto;

(d) isolation means including a ported metallic plate interposed between said speaker element and said microphone element, said isolation means for acoustically isolating said microphone element sufficiently from said speaker element such that the audible output from said speaker element does not create feedback to said microphone element, said transducer device thereby operative to permit two-way communication between a user and another party.

* * * * *